US008336798B2

(12) United States Patent
Rosen

(10) Patent No.: US 8,336,798 B2
(45) Date of Patent: Dec. 25, 2012

(54) APPARATUS FOR MATERIAL-BED COMMINUTION

(75) Inventor: Robert Rosen, Brackenheim (DE)

(73) Assignee: Hosokawa Bepex GmbH, Leingarten (DE)

( * ) Notice: Subject to any disclaimer, the term of this patent is extended or adjusted under 35 U.S.C. 154(b) by 160 days.

(21) Appl. No.: 12/994,498

(22) PCT Filed: May 22, 2009

(86) PCT No.: PCT/EP2009/003642

§ 371 (c)(1),
(2), (4) Date: Feb. 18, 2011

(87) PCT Pub. No.: WO2009/143990

PCT Pub. Date: Dec. 3, 2009

(65) Prior Publication Data

US 2011/0168823 A1 Jul. 14, 2011

(30) Foreign Application Priority Data

May 27, 2008 (DE) ..... 10 2008 025 373

(51) Int. Cl.
*B02C 4/28* (2006.01)

(52) U.S. Cl. ..... 241/225

(58) Field of Classification Search ..... 241/244–249, 241/222–225

See application file for complete search history.

(56) References Cited

FOREIGN PATENT DOCUMENTS

| | | | |
|---|---|---|---|
| DE | 550 692 | | 5/1932 |
| DE | 7237934 | U | 10/1972 |
| DE | 94 10 287 | U1 | 9/1994 |
| DE | 9417092 | U2 | 11/1995 |
| EP | 0159710 | A2 | 10/1985 |

OTHER PUBLICATIONS

International Search Report for International Appln. No. PCT/EP2009/003642 issued Sep. 11, 2009.

*Primary Examiner* — Mark Rosenbaum
(74) *Attorney, Agent, or Firm* — Carter, DeLuca, Farrell & Schmidt LLP

(57) ABSTRACT

Apparatus for the material bed comminution of wet agglomerations, in particular wet coke, has a storage container for material to be comminuted, and a material bed roller mill. For efficient grinding, the storage container takes the form of a storage silo having a discharge screw which is moved in two dimensions, wherein the discharge screw feeds the material to be comminuted from the storage silo to a compressor screw which is arranged directly upstream of the material bed roller mill and has at least one discontinuous screw blade.

12 Claims, 2 Drawing Sheets

APPARATUS FOR MATERIAL-BED COMMINUTION

TECHNICAL FIELD

The disclosure relates to apparatus for the so-called comminution of a material bed of wet agglomerations, which has a storage container for material that is to be comminuted and a material bed roller mill. In particular, the disclosure relates to apparatus for the material bed comminution of wet coke.

BACKGROUND

German patent 550 692 describes a method and apparatus in which pit-wet coal is metered into a stream of hot combustion gases. The combustion gas stream which is laden with wet coal particles is fed to a high-speed fan in which the coal particles are comminuted and at the same time dried. After passing through the fan, the combustion gas stream is passed to a separator, for example a cyclone, in order to remove the comminuted and dried coal particles from the combustion gas stream in known manner.

EP 0 159 710 A2 discloses a method and apparatus for grinding, among other things, wet coal or wet coke. The grinding method proposed in this publication provides two grinding surfaces between which grinding elements, in particular in the form of grinding rollers, are arranged. The two grinding surfaces may be planar or indeed curved, for example cylindrical, and may be arranged horizontally, vertically or inclined at any angle.

German Utility Model specification DE 94 17 092 U1 discloses and describes a means of feeding material for a material bed roller mill which is operated in a closed grinding and classifying cycle. Based on this mode of operation, the material being ground which is fed to the material bed roller mill includes a high proportion of fine particles which may readily be fluidised, which presents a problem for the construction of a material bed as required for proper functioning. To overcome this problem, it is proposed to use as the silo discharge means a horizontal-axis twin screw which is operated in opposing directions, and to supply this twin screw, in opposition to the pressure of an overflow valve, with an excess of material by way of at least one vertical-axis compressor screw. It is stated that the counter-pressure exerted by the overflow valve has the effect of pre-compressing the conveyed material and hence completely filling the screw flights of the twin screw with a material of high bulk density. It is stated that completely filling of the screw flights of the compressor screw is ensured by the conveying output of the twin screw, which is always greater than that of the compressor screw.

German Utility Model specification DE 72 37 934 U1 discloses a silo for powdered or granular material which is provided with a discharge means in the form of a conveyor screw which on the one hand rotates about itself and on the other at the same time performs a translational movement above the base of the silo. Disadvantages of a construction of this kind which should be mentioned are on the one hand the tendency of the material in the silo to form bridges and on the other the poor accessibility of the discharge means in the event of damage to the discharge conveyor and its drive system. To overcome these problems, it is proposed to pass a hollow support which opens into two lateral silo openings through the lower end region of the silo, this hollow support being dimensioned and arranged such that it covers the drive mechanism of the discharge conveyor by means of its central region and keeps this drive mechanism accessible and prevents the formation of a naturally occurring bank of material in the direction of the centrally arranged outlet opening.

German Utility Model specification DE 94 10 287 U1 discloses a screw compressor having an infeed aid. The screw compressor is intended to serve to reduce the volume of bulky substances, such as used cardboard packaging, by compressing them. To ensure that the material put into the screw compressor is fed without problems, a shaft having at least two infeed elements parallel to the screw axis is arranged in the input hopper above the compressor screw and is driven in a direction of rotation opposed to that of the screw shaft. In this way, an infeed action is to be established between the compressor screw and the shaft.

In known methods for comminuting wet coal or wet coke, for example using a vertical roller mill, it is disadvantageous in practice that the complexity of the apparatus for drying the wet coal or wet coke and for the prevention of dust explosions must be high. In addition, at relatively high pressing forces, which are desirable per se for proper comminution, a vertical roller mill tends to flake formation, that is to say that flake-like agglomerations of fine particles are formed, and these make it extremely difficult or even impossible to remove the fine material in the classifying zone of the vertical roller mill, because the fine fraction of the comminuted material that has agglomerated in this way can no longer be removed by the air flow acting in the classifying zone. To prevent flakes from forming, a low specific grinding force is therefore established in a vertical roller mill, and this has the effect of reducing the level of comminution. In addition, the formation of flakes impairs the function of a mill with concentric cylindrical grinding surfaces.

SUMMARY

The object of the disclosure is to provide improved apparatus for the material bed comminution of wet agglomerations which achieves a good ultimate fineness of the material to be comminuted in the most efficient manner possible and which does not require highly complex apparatus for recognising and/or preventing dust explosions.

According to the disclosure, this object is achieved by apparatus having the features specified in Claim 1. According to this, the apparatus according to the disclosure uses as the storage container a storage silo having a discharge screw which is moved in two dimensions, wherein the discharge screw feeds the material to be comminuted from the storage silo by way of feed lines to a compressor screw which is arranged directly upstream of the material bed roller mill. The compressor screw is provided with at least one discontinuous screw blade such that the discontinuous screw blade is divided into segments, and between each of these there is a clear space.

Wet agglomerations, in particular wet coal or wet coke, have poor flow properties. As a result of using the discharge screw which is moved in two dimensions—which not only rotates about its own longitudinal axis but is moreover moved in its entirety along a predetermined path—a continuous material feed in the direction of the material bed roller mill is ensured. In particular, using a discharge screw which is moved in two dimensions of this kind, it is possible to force a mass flow in the storage silo, that is to say that the storage silo is preferably a mass flow silo.

According to an embodiment, the discharge screw rotates about its longitudinal axis and is moreover moved up and down in the discharge region of the storage silo. The up-and-down movement can in this case be in the vertical direction or in a direction inclined with respect to the vertical, it also being possible for example for the rotating discharge screw to move alternately obliquely upward in one direction and then obliquely upward in another direction. In a preferred embodiment, the discharge screw rotates in two dimensions, that is to say on the one hand it rotates about its longitudinal axis and on the other is moved in the peripheral direction in the discharge region of the storage silo, for example along a circular path. If in this case the discharge screw is seated centrally in a cylindrical storage silo, then as a result of its movement in the peripheral direction it reaches almost every point in the circular discharge region of the storage silo. The plane in which the movement of the discharge screw in the peripheral direction takes place may be horizontal or indeed inclined with respect to the horizontal. It is also possible for the discharge screw to perform a movement in the peripheral direction on which a wave-like up-and-down movement is superimposed.

The compressor screw which according to the disclosure is arranged directly upstream of the material bed roller mill presses the material to be comminuted, which is fed by the discharge screw, reliably into the roller gap in the material bed roller mill. The compressor screw is specially adapted to convey wet agglomerations, in particular wet coke, by having discontinuous screw blades. Preferably, all the screw blades of the compressor screw are constructed to be discontinuous.

The apparatus according to the disclosure makes it possible to comminute lumpy wet feed material such as wet coke, whereof the size of the feed material is up to 10 mm and the moisture content is up to 20 wt %, in a single pass to give a high ultimate fineness. For example, it is readily possible to take a wet feed material having a particle size in which 97% of the mass is smaller than 8 mm and, with a single pass through the roller gap, to achieve a particle size distribution at which approximately 70% of the mass is smaller than 200 μm. During this, the moisture content remains constant and no water is pressed out. Rather, the pore volume of the coke is still capable of taking up a water content of up to approximately 20 wt %.

On passage through the roller gap, partly pressed agglomerations, so-called flakes, are produced, but because of the high degree of ultimate fineness achieved even on a single pass through the roller gap these no longer require classification but may be fed directly to further use; for example, they may be fed on a conveyor belt to an oven to be fired.

So that the two grinding rollers, which are pressed against one another at high pressure, have a long service life, the roller surface of each grinding roller is preferably provided with an anti-wear layer which is applied for example by hard surfacing.

Because, in the apparatus according to the disclosure, the material being ground is comminuted in a single pass to the required ultimate fineness, the multiple passes required in other methods are dispensed with. Nor is there any need for a closed grinding and classifying cycle. The result is that significantly less energy is used to produce the end product, and furthermore the energy conventionally used in drying need not be applied, since the material for grinding is fed and further processed in the wet condition. There is therefore no risk of dust explosion.

BRIEF DESCRIPTION OF THE DRAWINGS

An exemplary embodiment of the apparatus according to the disclosure will be explained in more detail below with reference to schematic figures, in which.

DETAILED DESCRIPTION

Figure 1:
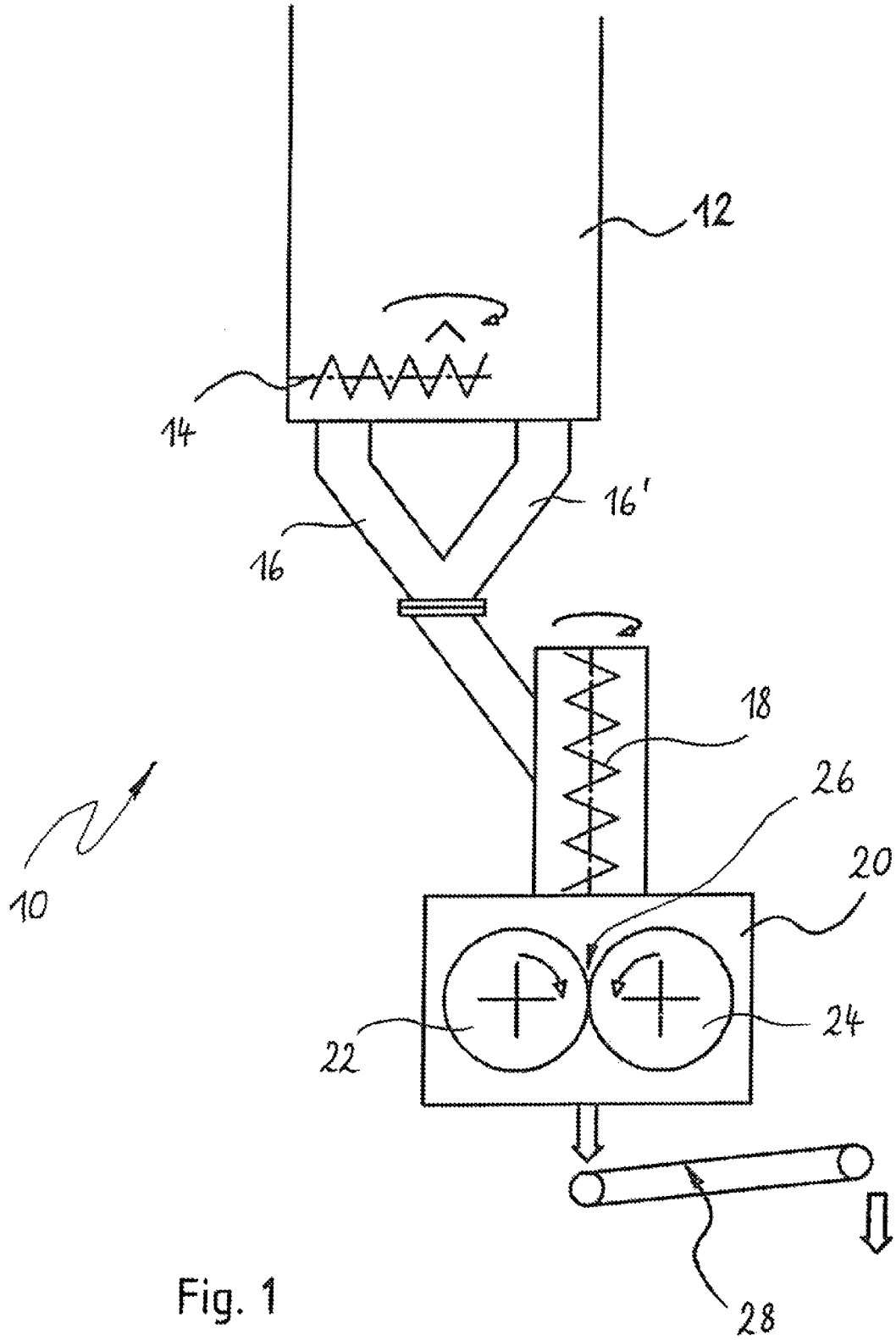
FIG. 1 shows an embodiment of apparatus according to the disclosure for the material bed comminution of wet coke.

FIG. 1 illustrates apparatus which is designated 10 overall, for the material bed comminution of wet coke. The apparatus 10 includes a storage silo 12 for the wet coke to be comminuted, with a discharge screw 14 arranged in the bottom of the storage silo 12.

So that the wet coke, which is lumpy and flows only poorly, can be discharged continuously from the storage silo 12, the discharge screw 12 rotates in two dimensions, that is to say it is rotated not only about its longitudinal centre axis but is moreover moved in its entirety along a predetermined path. In the exemplary embodiment illustrated, the entire rotating discharge screw 14 is moved along a circular path in the lower region of the storage silo 12 by means of a geared motor (not illustrated) which is mounted centrally in the storage silo 12. A wave-like up-and-down movement may at the same time be superimposed on the movement along the circular path. As an alternative, the rotating discharge screw 14 may also be moved only up and down in the lower region of the storage silo 12.

As a result of the discharge screw 14 which rotates in two dimensions as described, a mass flow which flows continuously in feed lines 16 and 16' is forced and maintained in the storage silo 12. The feed lines 16, 16' open into a compressor screw 18 which feeds the wet lumpy coke material to a material bed roller mill 20 which has two grinding rollers 22, 24 which rotate in opposing directions and between which is formed a roller gap 26.

The compressor screw 18 is arranged directly upstream of the roller mill 20 and presses the wet coke into the roller mills 20, or to be more precise into the roller gap 26. The two grinding rollers 22, 24 are pressed against one another at high pressure such that the wet coke material passing through the roller gap 26 is comminuted to an extreme degree.

During its passage through the roller gap 26, the wet lumpy coke material which is pressed into the roller gap 26 by means of the compressor screw 18 is formed into partly pressed agglomerations of small particles of coke, called flakes. These flakes and the rest of the coke material that is comminuted in the roller gap 26 fall downwards out of the roller gap 26 and onto a conveyor belt 28 which feeds the comminuted wet coke to a desired further use. For example, in this way the comminuted wet coke may be fed to a furnace.

Figure 2:
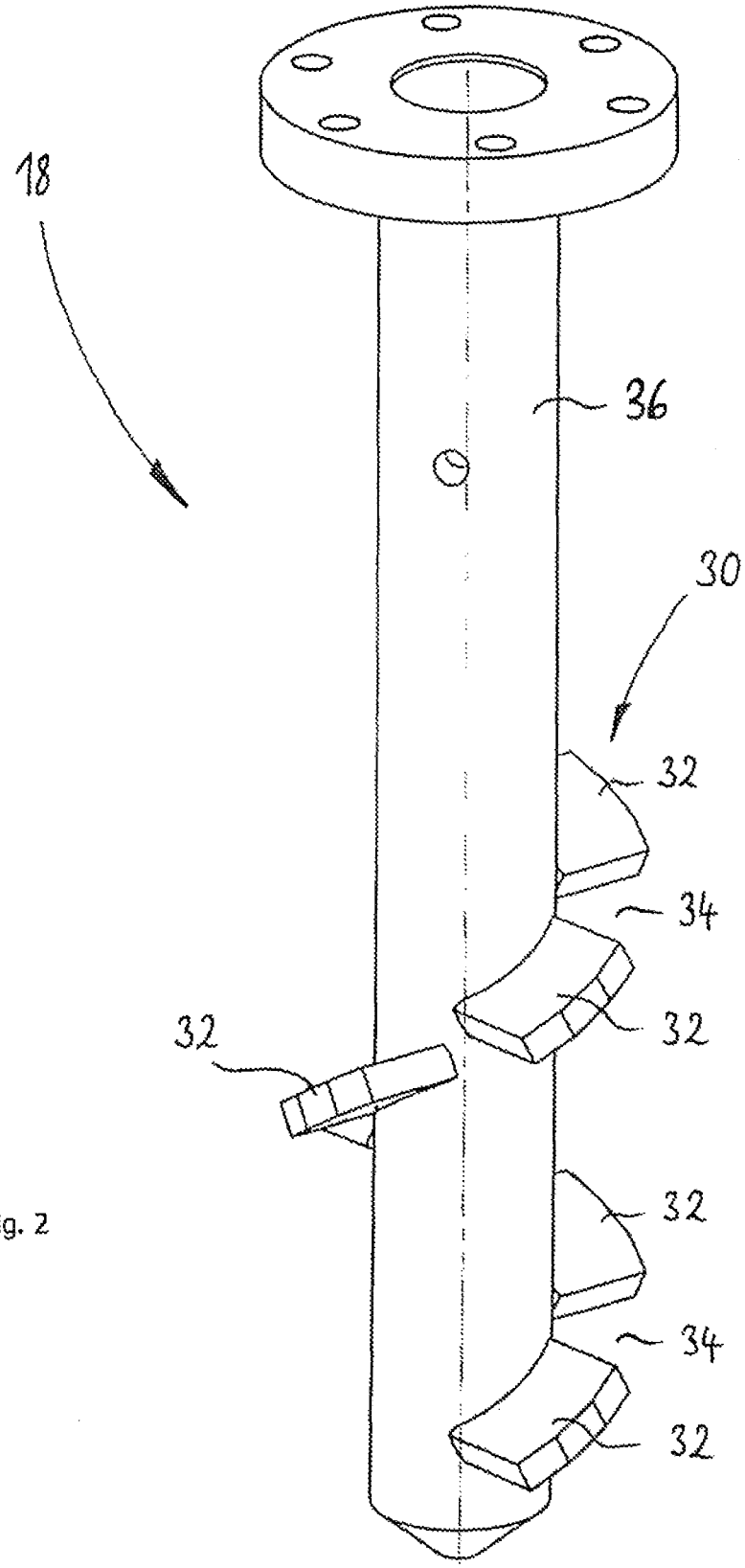
FIG. 2 shows a perspective view of a compressor screw used in the apparatus from FIG. 1, on a larger scale.

FIG. 2 illustrates the compressor screw 18 in more detail. As is readily apparent, in contrast to conventional compressor screws the compressor screw 18 does not have continuous screw blades, but rather the screw blade 30, of which there is only one in this case, is of discontinuous construction and is divided into segments 32, and between each of these there is a clear space 34. The segments 32 which form the discontinuous screw blade 30 are arranged on a cylindrical core 36, and it is apparent that the screw blade 30 does not extend over the entire length of the cylindrical core 36 but is only located in the region of the front half, the half adjacent to the free end of the compressor screw 18. The clear spaces 34 between adjacent segments 32 are only approximately half the size of each segment 32, as seen in the direction of the screw blade 30.

Tests of the material bed comminution of wet coke were carried out using apparatus 10 constructed as indicated above, with the feed particle size of the fed coke material having 97 mass % <8 mm and the moisture content being 15 to 20 wt %. After a single pass through the roller gap 26, a particle size distribution of approximately 75 mass % <200 μm was achieved. During this, the moisture content remained constant and no water was pressed out. The temperature corresponded to ambient temperature and there was no measurable increase in temperature during grinding.

The roller mill 20 used for the tests had grinding rollers 22, 24 with a diameter of 520 mm and a working width of 180 mm. The compressor screw 18 had a diameter of 170 mm. The throughput which can be achieved with apparatus of this kind was approximately 8 t/h.

The invention claimed is:

1. Apparatus for the material bed comminution of wet agglomerations, comprising:

a storage container for material to be comminuted, and a material bed roller mill, wherein the storage container is a storage silo having a discharge screw which is moved in two dimensions, wherein the discharge screw feeds the material to be comminuted from the storage silo by way of feed lines to a compressor screw which is arranged directly upstream of the material bed roller mill, and the compressor screw has at least one discontinuous screw blade such that the discontinuous screw blade is divided into segments, and between each of these there is a clear space.

2. Apparatus according to claim 1, wherein the discharge screw rotates in two dimensions.

3. Apparatus according to claim 2, wherein the discharge screw rotates about its longitudinal axis.

4. Apparatus according to claim 2, wherein the discharge screw performs in its entirety a rotation about an axis perpendicular to its longitudinal axis.

5. Apparatus according to claim 1, wherein each clear space between adjacent segments is only approximately half the size of each segment, as seen in the direction of the screw blade.

6. Apparatus according to claim 1, wherein the discontinuous screw blade is only located in the region of the front half.

7. Apparatus according to claim 6, wherein the front half is adjacent to a free end of the compressor screw.

8. Apparatus according to claim 1, wherein all the screw blades of the compressor screw are constructed to be discontinuous.

9. Apparatus according to claim 1, wherein the storage silo is a mass flow silo.

10. Apparatus according to claim 1, wherein the material bed roller mill has a single roller gap.

11. Apparatus according to claim 10, wherein a conveyor belt is arranged below the single roller gap.

12. Apparatus according to claim 1, wherein the material bed roller mill has grinding rollers which are provided with an anti-wear layer.

* * * * *